US008485837B2

(12) United States Patent
Head

(10) Patent No.: US 8,485,837 B2
(45) Date of Patent: Jul. 16, 2013

(54) ELECTRICAL WET CONNECTOR IN DOWNHOLE ENVIRONMENT

(75) Inventor: Philip Head, Egham (GB)

(73) Assignee: Artificial Lift Company Limited, Staines (GB)

( * ) Notice: Subject to any disclaimer, the term of this patent is extended or adjusted under 35 U.S.C. 154(b) by 22 days.

(21) Appl. No.: 13/265,922

(22) PCT Filed: Apr. 22, 2010

(86) PCT No.: PCT/GB2010/050657

§ 371 (c)(1), (2), (4) Date: Oct. 24, 2011

(87) PCT Pub. No.: WO2010/122342

PCT Pub. Date: Oct. 28, 2010

(65) Prior Publication Data

US 2012/0045917 A1 Feb. 23, 2012

(30) Foreign Application Priority Data

Apr. 22, 2009 (GB) ..... 0906899.0

(51) Int. Cl.
*H01R 4/60* (2006.01)

(52) U.S. Cl.
USPC ..... 439/190; 166/66

(58) Field of Classification Search
USPC .. 439/190–196, 198, 199, 201, 205; 166/340, 166/65.1, 66, 66.4
See application file for complete search history.

(56) References Cited

U.S. PATENT DOCUMENTS

| | | | | |
|---|---|---|---|---|
| 3,398,392 | A | 8/1968 | Henderson | |
| 4,174,875 | A | 11/1979 | Wilson et al. | |
| 4,589,717 | A * | 5/1986 | Pottier et al. | 439/277 |
| 4,767,349 | A | 8/1988 | Pottier et al. | |
| 4,825,946 | A | 5/1989 | Schnatzmyer | |
| 4,997,384 | A | 3/1991 | Godfrey et al. | |
| 5,222,770 | A * | 6/1993 | Helevirta | 285/53 |
| 5,577,925 | A * | 11/1996 | Schnatzmeyer et al. | 439/191 |
| 5,967,816 | A * | 10/1999 | Sampa et al. | 439/190 |
| 6,511,335 | B1 * | 1/2003 | Rayssiguier et al. | 439/191 |
| 6,758,272 | B2 * | 7/2004 | Bixenman et al. | 166/255.1 |
| 7,462,051 | B2 * | 12/2008 | Hall et al. | 439/194 |
| 7,900,698 | B2 * | 3/2011 | Stoesz | 166/242.6 |

OTHER PUBLICATIONS

International Search Report, Jul. 2009.
Written Opinion, Jul. 2009.

* cited by examiner

*Primary Examiner* — Thanh Tam Le
(74) *Attorney, Agent, or Firm* — Fay Sharpe LLP

(57) ABSTRACT

An electrical connection for use in boreholes or other remote environment has first and second conductive members. The two conductive members are movable to form an electrical contact. Also provided is a means for urging dielectric fluid around the electrical contact formed by the first conductive member and second conductive member as the first and second conducting members are moved together.

14 Claims, 12 Drawing Sheets

ELECTRICAL WET CONNECTOR IN DOWNHOLE ENVIRONMENT

CROSS-REFERENCE TO RELATED APPLICATIONS

This application is a national stage entry of international application number PCT/GB2010/050657, having international filing date of Apr. 22, 2010, which was published in English, and which claims priority to Great Britain Patent Application No. GB 0906899.0, filed Apr. 22, 2009, the entireties of which are hereby incorporated by reference as if fully set forth herein.

FIELD OF THE INVENTION

This invention relates to electrical connections for conductors in a downhole environment, particular connections that are engageable and releasable downhole.

BACKGROUND OF THE INVENTION

An oil or gas well may use many types of apparatus that require an electric connection, such as tools and measuring devices that are lowered down the well, and equipment that is installed or present in a casing or production tube. Electrical power for these tools is usual supplied through a conductive line from the surface extending from the tool to the surface. Sometimes a conductive line must be disposed down the well to attach to the tool, rather than the tool being lowered with the conductive line already attached. There are many reasons why the conductive line is not always installed simultaneously with the tool; the tool may have been installed with or incorporated in the casing or production tube, or it may be convenient to install a particular tool down a casing or production line without an electric line, or an already attached electric line may have to be recovered due to a fault or to allow another tool access.

To make an electric connection in this downhole environment, it must be ensured firstly that the lowered connector locates and engages securely with the installed connector, and further that well fluid and material suspended in the well fluid does not penetrate between the surfaces of the connectors to prevent or degrade the conduction between the connection. Ideally, the connection should be reversible without damaging the connectors, allowing the lowered connection to be released and removed from the well, and re-lowered and re-attached as many times as necessary.

It is an object of the present invention to effectively protect the electric connection between the lowered and installed connectors.

SUMMARY OF THE INVENTION

According to the present invention, there is provided apparatus for making an electrical connection in a borehole or other remote environment comprising;

a first connection assembly having a first conductive member, a second connection assembly having a second conductive member, the first conductive member and second conductive member being movable to form an electrical contact, and a means for urging dielectric fluid around the electrical contact formed by the first conductive member and second conductive member as the first and second conducting members are moved together.

According to another aspect of the invention, there is also provided apparatus for making an electrical connection in a borehole or other downhole environment comprising;

a first connection assembly having a first conductive member, a second connection assembly having a second conductive member and a retractable member, the retractable member covering the first or second conductive member, a cammed surface, a latching means that can interact with the cammed surface to secure the first connection assembly and second connection assembly together, the retractable member moving on the first or second connection assembly to expose the first or second conductive member, dynamic seals that wipe across the first or second conductive member, the first conductive member and second conductive member being movable to form an electrical contact.

According to further aspect of the invention, there is also provided a first connection as herein defined, and a second connection as herein defined.

DETAILED DESCRIPTION

Figure 1:
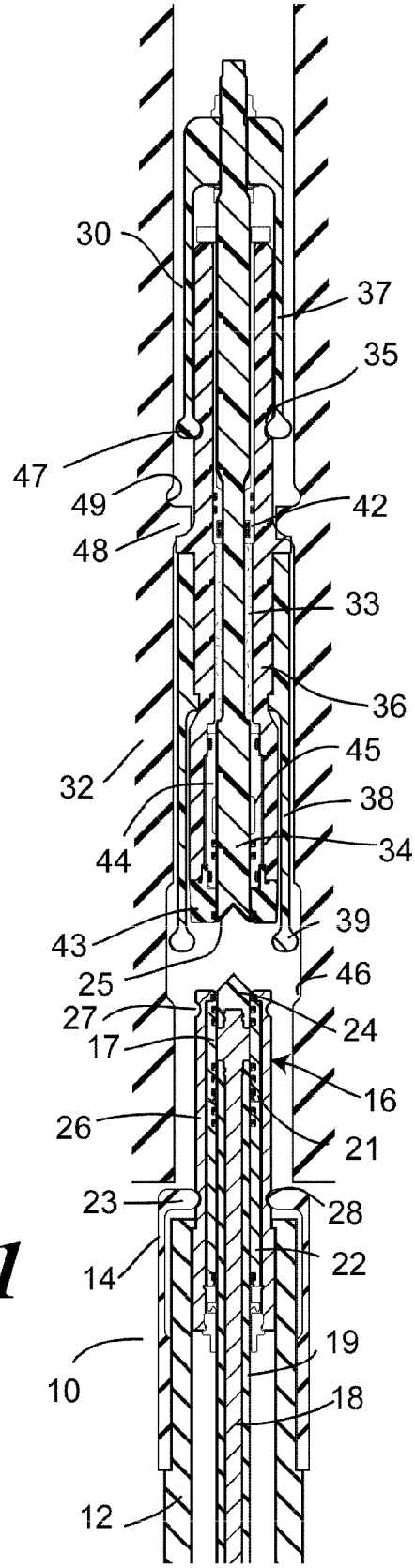
FIG. 1 shows a front longitudinal sectional view of the electrical connection system, in an unengaged state.

Referring to FIG. 1, a male electrical connection assembly 10 is installed in a well bore (not shown), and a female electrical connection assembly 30 is lowered down the well to be swung into a side window 32 of a casing string having a shaped guide surface above the male connection assembly 10.

The male connection assembly comprises a male probe 16 which extends through a housing 12, and a retaining member 14 which comprises flexible fingers ending in radially inward pointing lugs 23 which locates the male probe 16. The male probe 16 has a conductor rod 18 that terminates at its lower end to supply a tool or measuring device, and which extends along the bore of the housing 12. The conductor rod 18 is surrounded for most of its length by an insulating layer 19. The insulating layer terminates at the upper end of the conductor rod 18, revealing an exposed conductive surface 17 of the conductor rod. The upper part of the conductor rod 18 and the insulating layer 19 are enclosed by dynamic seal carriers 21, 22. A protective sheath 26 encloses the upper part of the conductive rod and dynamic seal carriers 21,22, including the conductive surface 17. A conical mating surface 24 is situated that the tip of the male probe 16.

Figure 4:
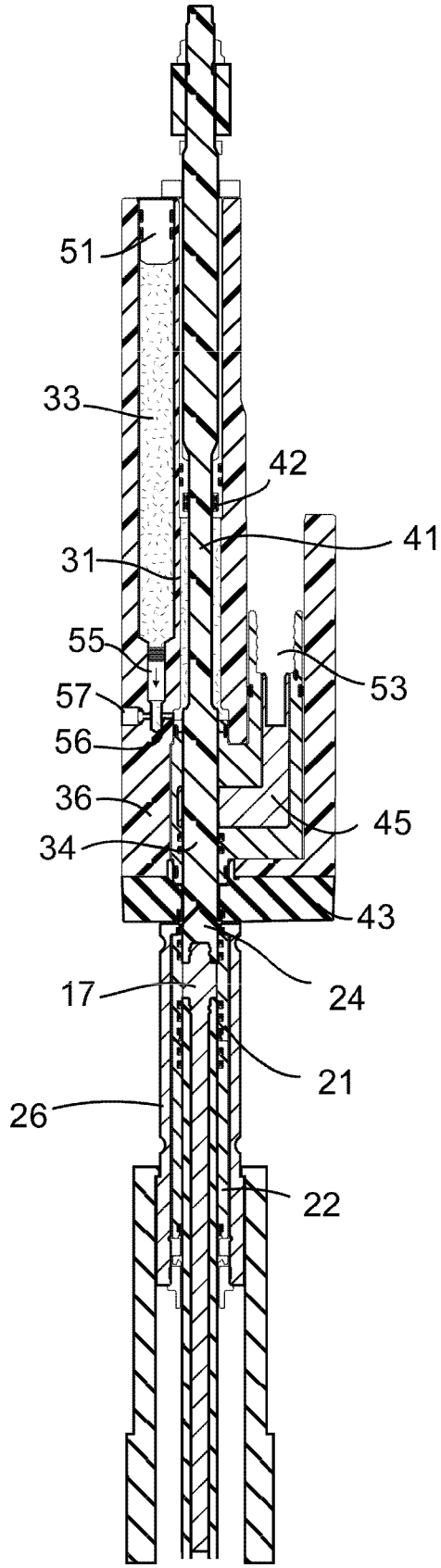
FIG. 4 shows a side sectional view of the electrical connection system, in an partly engaged state.

The female electrical connection assembly 30 is disposed in a side window 32 in a casing string. A central rod 34 extends through the bore of a shaped inner tube 36. Between the inner surface of the side window 32 and the outer surface of the shaped inner tube 36, an upper finger member 37 and a lower finger member 38 are located. The central rod also extends through dynamic seal carriers 42, 43, 44. A conductive surface 45 is exposed on the inner surface of dynamic seal carrier 44. The conductive surface 45 leads to a socket 53, (shown in FIGS. 4 and 5) which leads to a tool to be powered. A cable from the surface (not shown) supplies the male probe 16 with electric power.

The shaped inner tube 36 can slide over the central rod 34, depending upon the configuration of the finger members 37, 38 which will be described below. The central rod 34 and upper finger member 37 are secured together. The shaped inner tube 36 and the lower finger member 38 are also secured together.

In use, the male connection assembly 10 may be installed in a side window, and the female connection assembly 30 is lowered down beside the side window 32 and urged across into the side window, just above the male connection assembly 10.

Figure 2:
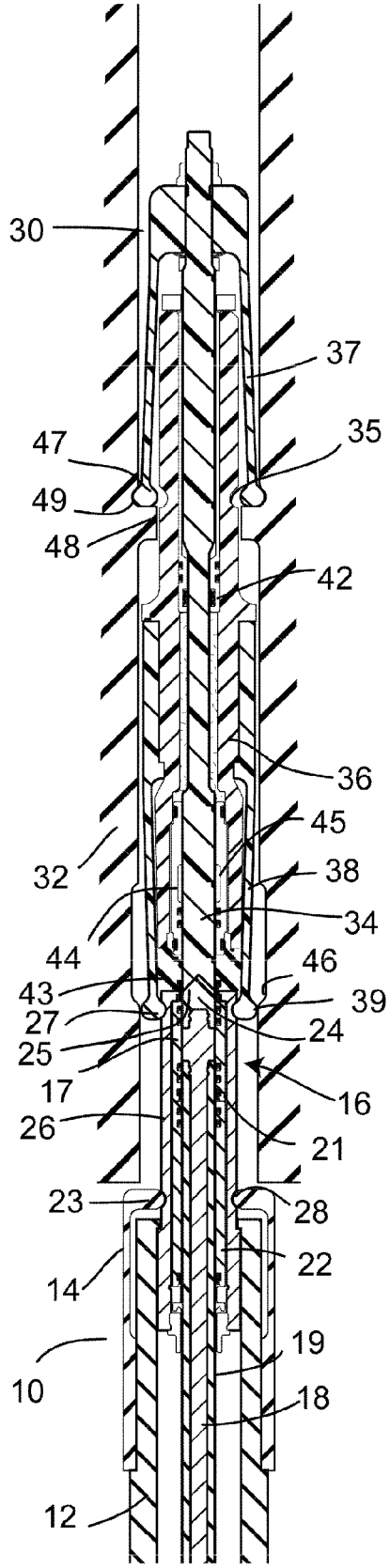
FIG. 2 shows a front longitudinal sectional view of the electrical connection system midway through engagement.

Referring also to FIG. 2, the central rod 34, shaped inner tube 36 and upper and lower finger members 37, 38 continue to slide downwards inside the side window 32. This may be effected by gravity, or some other means such as applying weight or applying pressurised fluid above the components.

The lower finger member 37 comprises fingers fixed together at their upper end but free to flex at their free, downward-pointing end. Each free end terminates in a spherical collet 39, so that flexible fingers are biased to spring away from the central rod so that the collet 39 follows the profiled surface of the side window 32. The upper finger member is similar, and also has flexible fingers terminating in spherical collets 47.

The inner surface of side window 32 comprises a guide which has a lower recess 46, which the collets 39 of the lower finger member 38 abut against when the female connection member is in the unengaged position shown in FIG. 1. The inner surface of the side window guide also has an upper recess 49 with an inwardly extending shoulder 48 immediately beneath.

The central rod 34 has a inward conical mating surface 25 at its lower end which corresponds to the conical mating surface 24 protruding at the upper end of the male connection assembly 10. As the central rod 34, shaped inner tube 36 and upper and lower finger members 37, 38 slide down the shaped guide surface of the side window 32 towards the male connection assembly 10, the bottom of the central rod 34 abuts the top of the male connection assembly 10, and the conical mating surfaces 24, 25 engage.

At the same time, dynamic seal carrier 43 abuts the top of the protective sheath 26. Protective sheath 26 comprises upper indentations 27 on side external surfaces (corresponding to collet fingers profiles 37), just below the top of the sheath, and a lower indentation 28. As the lower finger member 38 descends through the shaped guide surface of the side window 32, the collets 39 come to the lower end of the lower recess 46, and are forced radially inward by the reduction of the inner diameter of the lower recess 46. The collets 39 are forced to engage with the indentation 27 of the protective sheath 26.

In the unengaged state shown in FIG. 1, the collets 47 of the upper finger member 37 are held in an indentation 35 on the shaped inner tube 36, being inwardly constrained by the inner surface of the side window 32. At the same time that the central rod 34 has descended to abut the conical mating surface 24, the collets 47 of the upper finger member 37 reach the upper recess 49 of the side window 32 (as shown in FIG. 2). The upper recess 49 allows the collets 47 to spring radially outwards, disengaging from the indentation 35 on the shaped inner tube 36 and allowing the shaped inner tube 36 and lower finger member 38 to slide further down through the side window 32, while the central rod 34 and upper finger member 37 are constrained from further downward movement by the inwardly extending shoulder 48.

Figure 3:
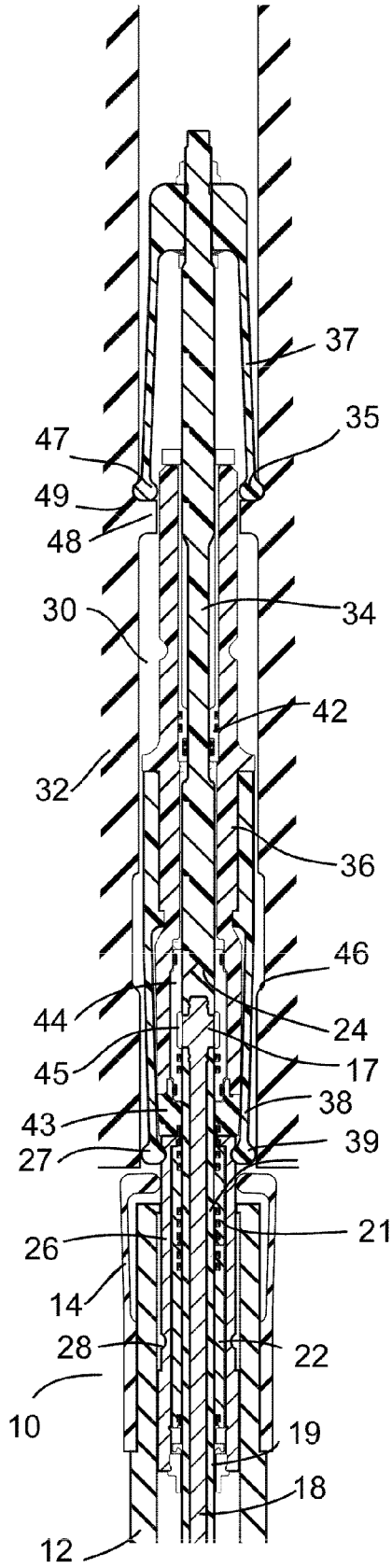
FIG. 3 shows a front longitudinal sectional view of the electrical connection system, in an engaged state.

Referring now to FIG. 3, shaped inner tube 36 and lower finger member 38 continue to slide down through the side window 32. Dynamic seal carriers 42 and 43 are attached to the shaped inner tube 36 and also move down. Dynamic seal carrier 43 exerts a downward force against protective sheath 26 and dynamic seal carriers 21, 22. Latching fingers on retaining member 14 spring outwards, disengaging the lugs 23 from indentation 28, releasing the protective sheath 26, and allowing the protective sheath 26 and dynamic seal carriers 21, 22 to slide down over the conductor rod 18.

The shaped inner tube 36 and lower finger member 38 continue descending until the collets 39 contact the top of the retaining member 14. By this point, the female connection assembly's dynamic seal carriers 42 and 43 have pushed down the male assembly's protective sheath 26 and dynamic seal carriers 21, 22, so that the dynamic seal carriers 42 and 43 have slid onto the conductor rod 18. When the female electrical connection assembly 30 and the male electrical connection assembly 10 are in this fully engaged position (as shown in FIG. 3), the exposed conductive surface 17 of the conductor rod 18 is adjacent and abutting the conductive surface 45 of dynamic seal carrier 44.

As the dynamic seal carriers 43, 44 slide down the conductor rod 18, they wipe the exposed conductive surface 17, to ensure that the electrical contact between the exposed conductive surface 17 of the conductor rod 18 and the conductive surface 45 of dynamic seal carrier 44 is sound.

The presence of water between electrical connection surfaces increases the resistance between electric contacts. To reduce this effect, dielectric oil is introduced between the electric contacts. However, even when mating surfaces are sealed, some water ingress occurs, accelerated by any heating and cooling and resulting expansion and contraction of parts of the system.

Figure 5:
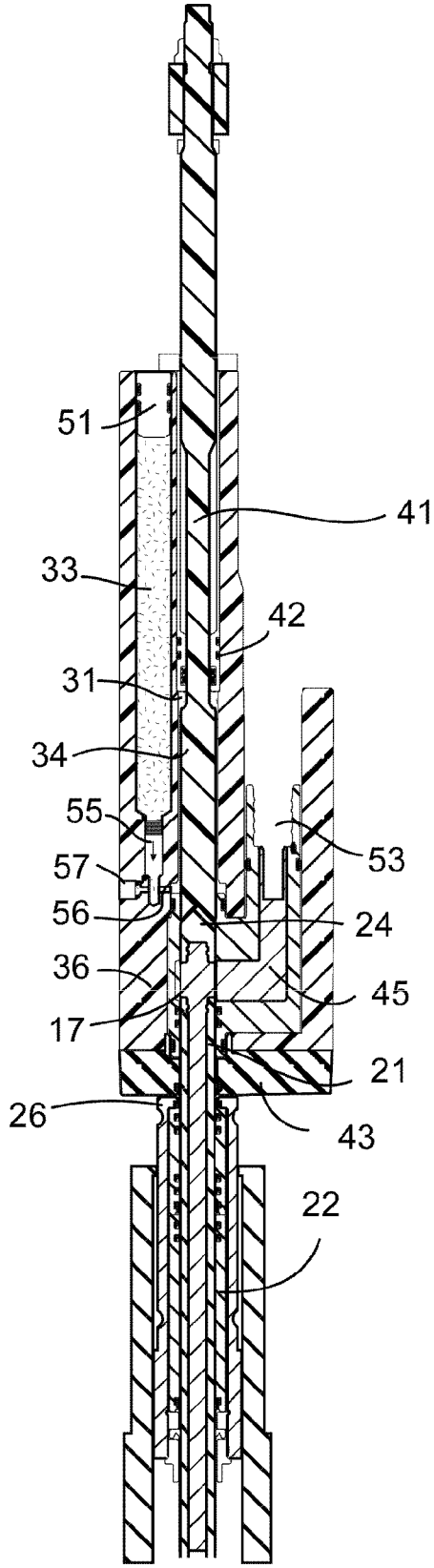
FIG. 5 shows a side sectional view of the electrical connection system, in a fully engaged state.

The central rod 34 has a narrow waist section 41, so that there is an annulus 31 between the central rod 34 and the shaped inner tube 36. The annulus is filled with protective dielectric fluid. Referring to FIG. 5, as the shaped inner tube 36 moves downwards over the central rod 34, dynamic seal carrier 42 reduces the volume of the annulus, forcing the dielectric fluid through the system, between the narrow gap between the central rod 34 and the dynamic seal carrier 44 and thence through the gap between the conductive rod 18 (in particular the conductive surface 17) and the dynamic seal carriers 21, 22, thus cleaning any residue and water from the well environment off the conductive surface 17. As described in greater detail below, the sealing system allows dielectric fluid to flow in one direction, but resists any flow in the opposite direction.

Referring to FIG. 5, as previously described, after the conical mating surface 24 of the male electrical connection assembly 10 has engaged with the inward conical mating surface 25 of the central rod 34, the shaped inner tube 36 continues to slide down over the central rod 34, pushing down the protective sheath 26 of the male assembly 10.

The dynamic seal carriers 21 and 43 pass over the conductive surface 17 to wipe off any well fluid that might have collected on the conductive surface 17. However, to ensure removal of such well fluid, further wiping operations together with application of the dielectric fluid can be performed.

Figure 6:
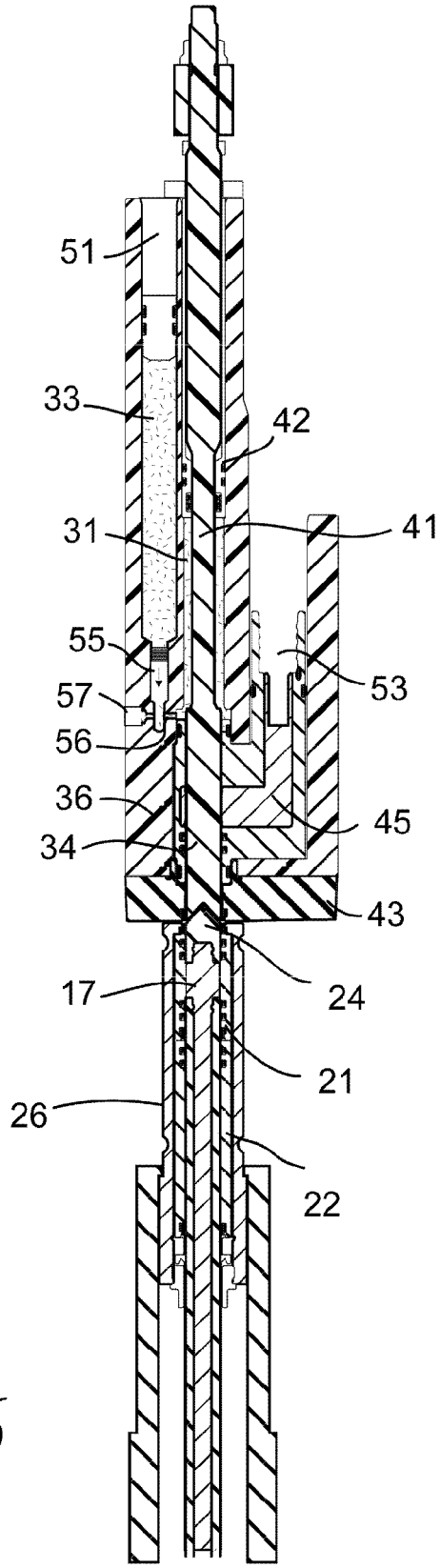
FIG. 6 shows a side sectional view of the electrical connection system, after being retracted from a fully engaged state.

A chamber 33 is located in the shaped inner tube 36, also filled with protective dielectric fluid. The chamber 33 in the shaped inner tube 36 is bounded at its upper end by a movable plug 51. At the chamber's lower end, a check valve 55 leads to port 56. A plug 57 seals the chamber from the well environment itself. Referring to FIG. 6, the shaped inner tube 36 may be pulled back up by the female electrical connection assembly 30. As the shaped inner tube 36 is secured to the lower finger member 38, and the collets 39 of the lower finger member 38 are engaged with the protective sheath 26, the protective sheath 26 and the dynamic seal carriers 21, 22 and 42 are drawn up along the conductive surface 17. Additionally, the dynamic seal carrier 42 moves upwards, increasing the volume of the annulus 31, lowering the fluid pressure therein, and drawing fluid through the check valve 55, replenishing the fluid in the annulus 31. The shaped inner tube 36 and dynamic seal carriers 21, 22 and 44 are once again allowed to descend to flush more dielectric fluid through the system and to complete the electrical connection between the male electrical connection assembly 10 and the female electrical connection assembly 30.

This cycle of lowering the female electrical connection assembly 30 to expel dielectric fluid from the annulus 31 to clean the electric connections, and drawing the female electrical connection assembly 30 back up to refill the annulus 31 from the chamber 33, can be continued as many times as necessary.

Also referring to FIG. 6, the conductive surface 45 on the inner surface of dynamic seal carrier 44 leads to a socket 53, via which power is supplied to a tool or sensor. Obviously, it will be realised that a cable could be supplied to the female electrical connection assembly 30 and a tool or sensor could be supplied by the male electrical connection assembly 10.

Figure 7:
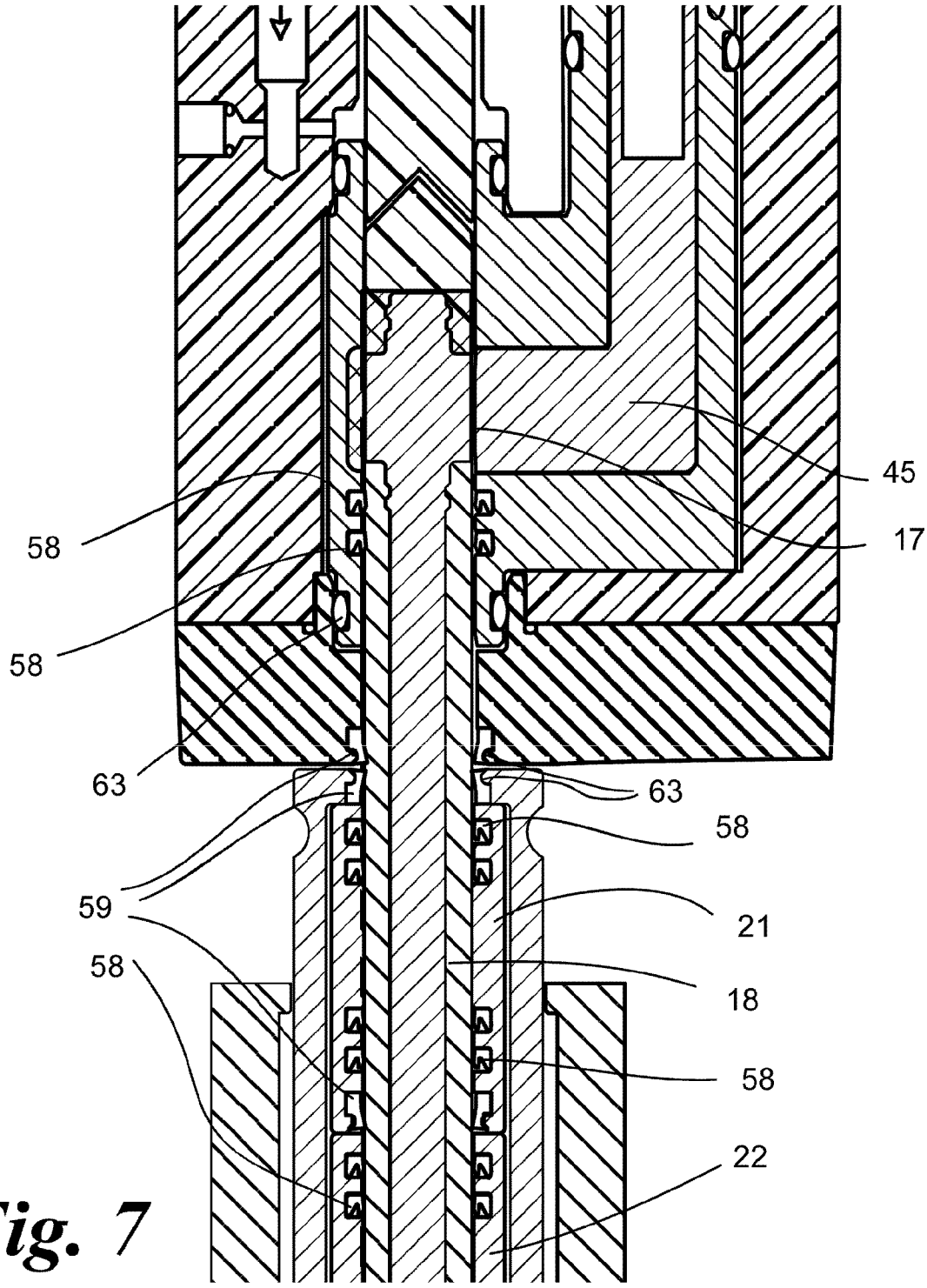
FIG. 7 shows a side sectional view of the electrical connection system in more detail.

Referring to FIG. 7, the assemblies may use various types of seals 54, 58, 59. For example, dynamic seal carriers 22, 43 and protective sheath 26 each feature seals 59 which have a generally rectangular section, but which are placed in a notch having an annular bead 61 at one side, which causes one side of the rectangular section of the seal 59 to protrude beyond the notch, so they are effective in sealing abutting parts such as the dynamic seal carrier 43 and the protective sheath 26, especially when two such seals abut. Other seals 58 may have a notched section, so that the conductor rod 18 and particular the conductive surface 17 has residue effectively scraped off its surface. Seals 58 may be made of a harder, less-deformable material than seals 59. Sealing joints 58, 59 are both made from materials that offer good sealing properties but allow the moving parts of the assembly to move without excessive frictional resistance. Joints not having movement between the parts, such as the connection between dynamic seal carriers 42 and 43, may be sealed with traditional sectioned o-rings.

The action of the embodiment described above depends upon the upon a downward force, such as the weight of the female electrical connection assembly 30. Additionally though, components could for example be biased by incorporating springs. In such a case, the seals would be chosen to have a very low resistance to movement.

In the above embodiment, the cleaning of the conductive surface 17 is carried out both by purging the conductive surface 17 and other parts of the system with dielectric fluid from the chamber 33, and by the wiping action of the seals 58. It may be though that in some situations it is necessary or preferable to rely on the scraping action of the seals alone, perhaps using stiffer seals or more positively urging the seals against the conductive surface 17 moving the reltive movement of the conductive surface 17 and the dynamic seal carriers, without using the purging action of the dielectric fluid. In such a case, the purging can be disabled by removing the check valve 57. If the purging action was not required, the embodiment could much reduce the chamber 33, though some access to the outside for means of pressure equalisation would still be beneficial.

The electric connection in the above example is described with the male electrical connection assembly 10 and female electrical connection assembly 30 disposed in a side window 32 of a casing string. The same principle could equally be applied to an electrical connection made in the main bore of a casing or production string; in such a case, rather than having a shaped side window pre-installed in a string, a shaped guide having a shaped inner surface corresponding to that of the side window 32 would be lowered down the string with the female electrical connection assembly 30 housed within it.

Figure 8:
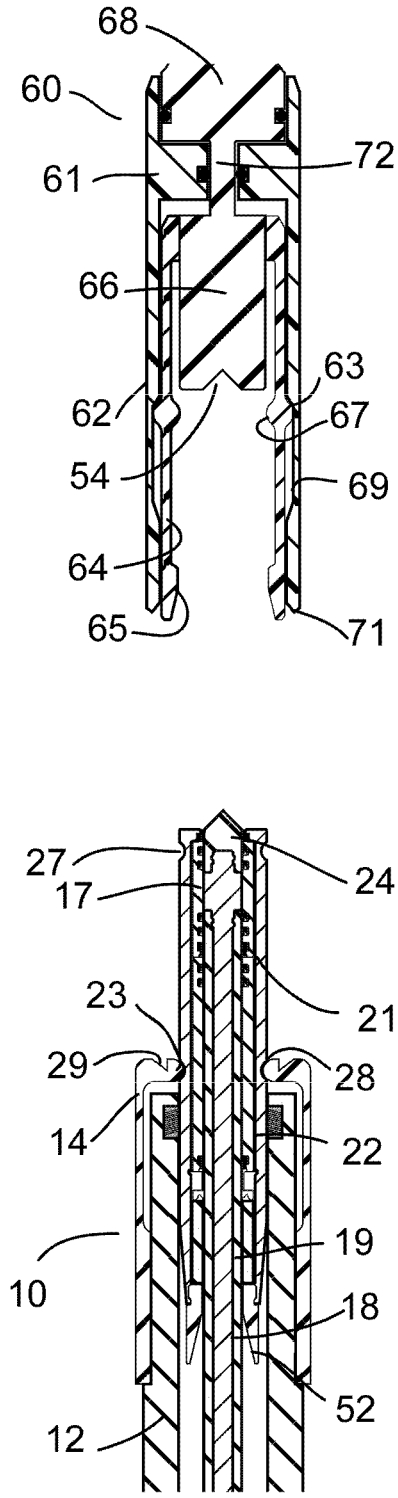
FIGS. 8 to 11 show a front sectional view of a related retrieval system.

Parts of the male connector assembly could be removable for repair or maintenance. Referring to FIG. 8, as in the previous embodiment, the male electrical connection assembly 10 has a male probe 16 having a conductor rod 18 which extends through a housing 12, and a retaining member 14 which locates the male probe 16. The upper part of the conductor rod 18 and its insulating layer 19 are enclosed by dynamic seal carrier 21. In this embodiment though, beneath the seal carrier 21 is a funnel 52. Also, retaining member 14 has fingers terminating with latching fingers which terminate with lugs 23 which feature notches 29.

Figure 9:
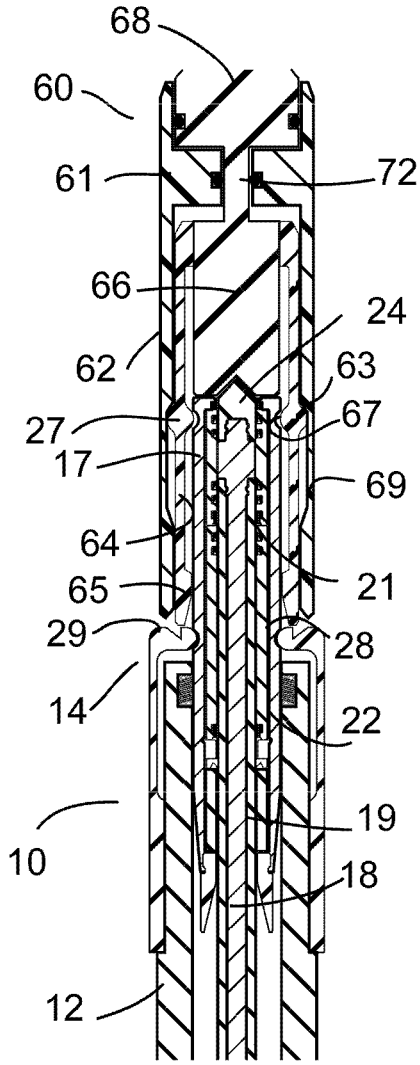

Referring to FIG. 9, a retrieval assembly 60 comprises a housing 62 which holds a slidable engagement member 66, and a finger member 64. The engagement member 66 is joined by a connecting rod 72 to a wireline connection member 68.

The connecting rod 72 passes through a flange 61 that secures the engagement member but allows some movement before the wireline connection member 68 abuts the flange. The engagement member 66 may be raised by injecting high pressure fluid between the connection member 68 and the flange 61.

As for the finger members of the previous embodiments, the finger member 64 comprises flexible fingers, the fingers being attached to the slidable engagement member 66 at their upper end but free to flex at their free ends. The fingers terminate with lugs 65, and also feature generally spherical collets 67 situated midway along the fingers. The housing 62 has a shaped inner surface, which features a recess 69 having a larger diameter than the remainder of the inner surface of the housing 62. The lower edge 71 of the housing 61 has a pointed section.

Referring to FIG. 9, as the retrieval assembly 60 is lowered onto the male electrical connection assembly 10, the conductor rod 18, dynamic seal carriers 21 and the protective sheath 26, until the conical mating surface 24 engages with an inward conical mating surface on the engagement member 66.

Figure 10:
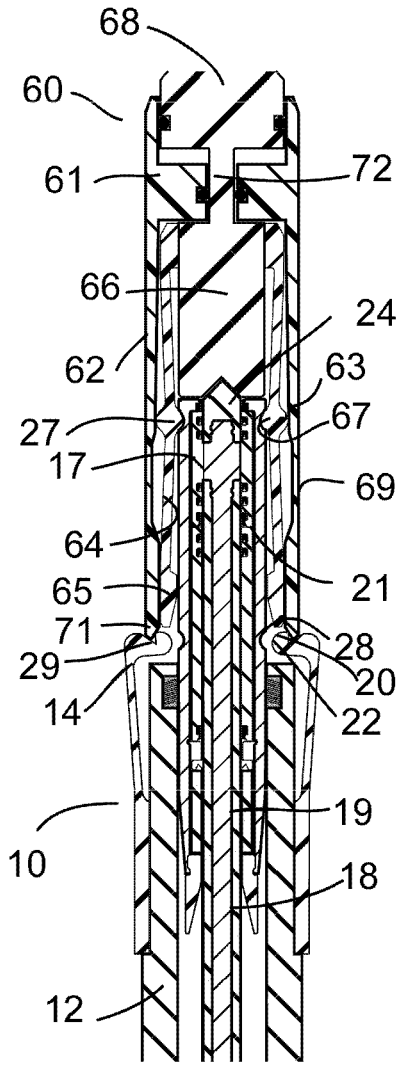

Referring to FIG. 10, fluid is injected between the connection member 68 and the flange 61, forcing engagement member 62 downwards so that it slides relative to the rest of the retrieval assembly 60 until it abuts the flange 61. The generally spherical collets 67 leave the recess 69 and are therefore forced radially inwards, engaging with the indentation 27 on the protective sheath 26, thereby securing the protective sheath to the retrieval assembly 60.

Retaining member 14 has features a rounded edge 20 which engages with the upper indentation 27 of protective sheath 26. As the engagement member 66 is forced upwards, the lugs 65 of finger members 67 engage with the rounded edge 20 of retaining member 14, and then the lower edge 71 of the housing 62 engages with the notches 29 of lugs 23. The lower edge of the housing 62 is prevented from flexing radially inwards by the lugs 65 of finger members 67, which abut the protective sheath 26. The lugs 23 are therefore forced to bend radially outwards, releasing the protective sheath 26 and the conducting rod 18 from the housing 12.

Figure 11:
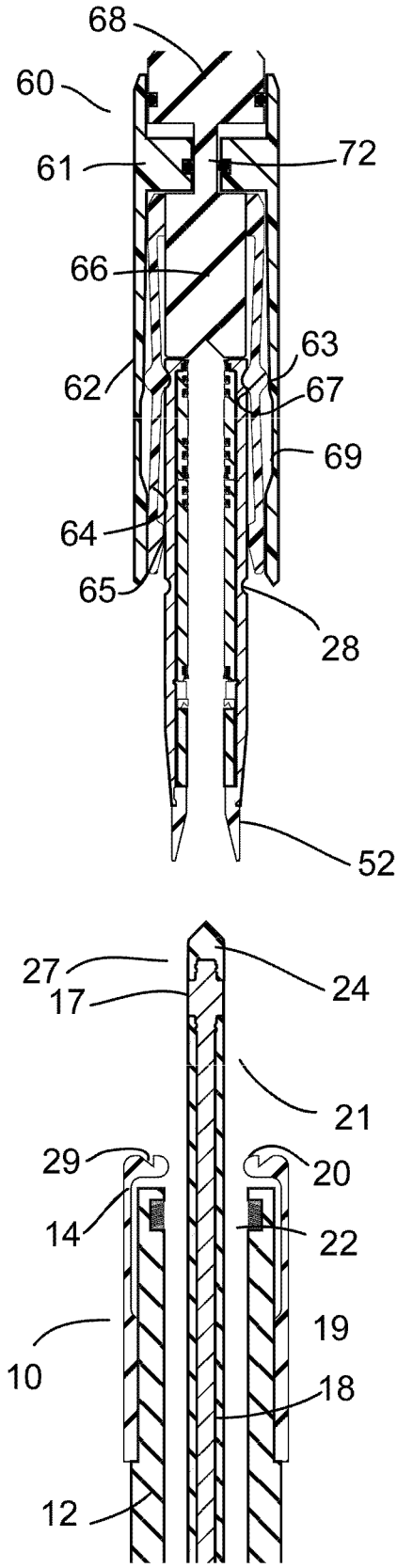

Referring to FIG. 11, the retrieval assembly 60 is now drawn up from the male electrical connection assembly 10. The protective sheath 26 and dynamic seal carrier 21 and funnel 52 are drawn up with the retrieval assembly 60, leaving the conducting rod 17.

The protective sheath 26 and dynamic seal carrier 21 may be replaced or repaired before being returned to the male electrical connection assembly 10. Reinstallation is effected by lowering the protective sheath 26 and dynamic seal carrier 21 on a similar assembly to the retrieval assembly 60. The funnel 52 has a flared shape to locate and fit over the conical mating surface 24 of the conductor rod 18. The inner surface of housing of the reinstallation assembly could be arranged such that a finger member 64 would disengage from the protective sheath 26 and dynamic seal carrier 21 as the reinstallation assembly neared the male electrical connection assembly housing 12. The shaped guide of the reinstallation assembly corresponding to housing 62 would be shorter, or the fingers of finger member corresponding to finger member 64 would not terminate in lugs 65. When the protective sheath 26 and dynamic seal carrier 21 are in position therefore, the lugs 23 of retaining member 14 engage with the lower indentation 28 of the protective sheath 26, and the reinstallation assembly may be drawn upwards to leave the protective sheath 26 and dynamic seal carrier 21 in place.

Figure 12:
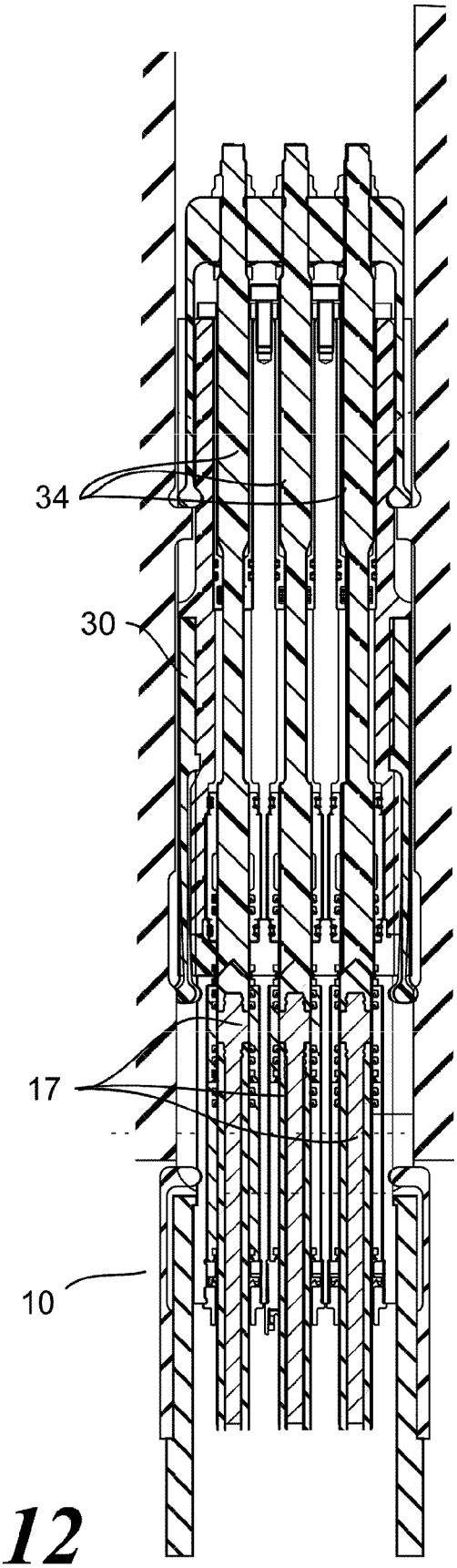
FIG. 12 shows a front sectional view of another embodiment of the connector system.

For simplicity, the electric connection system has been described using a single conductor rod in the male electrical connection assembly 10, and a single corresponding conductive surface in the female electrical connection assembly 30. In practice, many tools require three phase electrical power delivered via three conductive paths. Referring to FIG. 12, it will be seen that three phase power can be accommodated by providing three conductive rods 17 side-by-side in the male electrical connection assembly 10, which engage with three rods 34 in the female electrical connection assembly 30 to provide three separate conductive paths.

The embodiments described have a male electrical connection assembly 10 having a male probe 16 being the installed part; however, a male probe member have a retractable protective sheath could equally be lowered onto a previously installed female connection member.

The invention claimed is:

1. An electrical wet connection apparatus for use in a borehole, comprising:

a male connector comprising a first conductive member arranged within a protective sheath;

a female connector comprising a body defining a bore configured to receive the first conductive member, a rod slidably disposed in the bore, and a second conductive member arranged in the bore;

a chamber including dielectric fluid, the chamber being fluidly connected with the bore; and a finger member for releasably connecting the protective sheath to the female connector;

wherein the apparatus is configured to pump dielectric fluid from the chamber through the bore to flush the first conductive member by reciprocal movement of the body of the female connector and the first conductive member, one relative to the other, while the protective sheath is connected to the female connector.

2. An apparatus according to claim 1, wherein a non-return valve is arranged to permit replenishment of the bore with dielectric fluid from the chamber and to resist reverse flow from the bore to the chamber.

3. An apparatus according to claim 1, wherein the female connector is deployed in a guide or side window in the borehole, and the finger member is engageable and releasable by movement of the body of the female connector relative to the guide or side window.

4. An apparatus according to claim 3, wherein the finger member comprises a plurality of resiliently biased members which are urged to engage the retractable sleeve by sliding abutment with a profiled surface of the guide or side window.

5. An apparatus according to claim 3, wherein the rod includes an abutment element which engages an abutment surface of the guide or side window to restrain movement of the rod relative to the guide or side window during reciprocal movement of the body of the female connector relative to the guide or side window.

6. An apparatus according to claim 1, wherein the female connector is deployed in a guide or side window in the borehole, and the rod includes an abutment element which engages an abutment surface of the guide or side window to restrain movement of the rod relative to the guide or side window during reciprocal movement of the body of the female connector relative to the guide or side window.

7. An apparatus according to claim 1, wherein a retrieval tool is arranged to engage the retractable sleeve, remove it from the first conductive member, and recover it from the borehole.

8. An apparatus according to claim 1, wherein the retractable sleeve and the bore include dynamic seals which are arranged to wipe the first conductive member.

9. An electrical wet connection apparatus for use in a borehole, comprising:

a male connector comprising a first conductive member;

a female connector comprising a bore configured to receive the first conductive member, a rod slidably disposed in the bore, and a second conductive member arranged in the bore;

a chamber including dielectric fluid, the chamber being fluidly connected with the bore and arranged to replenish the bore with dielectric fluid when the first conductive member is withdrawn from the bore; and a non-return valve arranged to resist reverse flow from the bore to the chamber, such that the apparatus is configured to pump dielectric fluid from the chamber through the bore to flush the first conductive member by reciprocal movement of the body of the female connector and the first conductive member, one relative to the other.

10. An apparatus according to claim 9, wherein the first conductive member is arranged within a protective sheath.

11. An apparatus according to claim 10, wherein the protective sheath and the bore include dynamic seals which are arranged to wipe the first conductive member.

12. An apparatus according to claim 10, wherein a retrieval tool is arranged to engage the protective sheath, remove it from the first conductive member, and recover it from the borehole.

13. An apparatus according to claim 9, wherein the female connector is deployed in a guide or side window in the borehole, and the rod includes an abutment element which engages an abutment surface of the guide or side window to restrain movement of the rod relative to the guide or side window during reciprocal movement of the body of the female connector relative to the guide or side window.

14. An apparatus according to claim 9, wherein the bore includes dynamic seals which are arranged to wipe the first conductive member.

* * * * *